US005989656A

United States Patent [19]

Soloman

[11] Patent Number: 5,989,656

[45] Date of Patent: Nov. 23, 1999

[54] CONTAINER COVER WITH FOLIAGE

[76] Inventor: Michael Soloman, P.O. Box 2648, Lodi, Calif. 95241

[21] Appl. No.: 08/964,481

[22] Filed: Nov. 3, 1997

[51] Int. Cl.[6] ..... B65D 65/10

[52] U.S. Cl. ..... 428/17; 150/154

[58] Field of Search ..... 47/41.01, 41.11, 47/41.12, 41.13, 41.15, 26, 27, 28.1, 29, 31; D22/125, 199; 135/87, 96; 89/36.01; 383/42, 102; D2/883, 867; 428/919, 10, 7, 17; 52/4; 132/274; D9/435; 150/154

[56] References Cited

U.S. PATENT DOCUMENTS

| | | | |
|---|---|---|---|
| D. 244,293 | 5/1977 | Carluccio | D23/139 |
| D. 348,835 | 7/1994 | Cogliandro | D9/435 |
| D. 349,565 | 8/1994 | Burns et al. | D23/354 |
| 642,328 | 1/1900 | Heydrich | 47/41.01 |
| 805,814 | 11/1905 | Palmer | 47/31 |
| 2,113,523 | 4/1938 | White | 47/33 |
| 2,725,572 | 12/1955 | Marcellus | 2/207 |
| 2,798,500 | 7/1957 | Dietze | 132/274 |
| 2,911,652 | 11/1959 | Ekman | 89/36.01 |
| 3,899,620 | 8/1975 | Roeloffzen | 428/112 |
| 4,263,246 | 4/1981 | Mercer | 264/230 |
| 4,394,111 | 7/1983 | Wiese | 417/360 |
| 5,171,390 | 12/1992 | Travers | 156/212 |
| 5,241,782 | 9/1993 | McCarthy et al. | 47/29 |
| 5,456,062 | 10/1995 | Wechsler | 53/468 |
| 5,510,167 | 4/1996 | Candolfi | 428/107 |
| 5,535,543 | 7/1996 | Alexander | 47/26 |
| 5,579,610 | 12/1996 | Jackson | 52/4 |
| 5,743,458 | 4/1998 | French | 229/87.03 |

FOREIGN PATENT DOCUMENTS

| | | | |
|---|---|---|---|
| 23573 | 4/1901 | France | 47/41.12 |

*Primary Examiner*—Robert P. Swiatek
*Assistant Examiner*—Son T. Nguyen

[57] ABSTRACT

A container cover with foliage (10) functioning to aesthetically cover a container (18). The container cover with foliage (10) has a net cover (12) which comprises a left net cover (12L) attached along a front distal edge to a left distal edge of a front net cover (12F) which is attached along a right distal edge to a front distal edge of a right net cover (12R) which is attached along a rear distal edge to a right distal edge of a back net cover (12B) which is attached along a left distal edge to a rear distal edge of the left net cover (12L). A net cover top (12T) is attached along a left edge and a right edge and a front edge and a back edge to a top edge of the left net cover (12L) and the right net cover (12R) and the front net cover (12F) and the back net cover (12B), respectively. A bottom net cover (12A) is located circumferentially along a bottom edge of the net cover (12). The container cover with foliage (10) further has an elastic cord (14) is positioned within a closed flap formed in the bottom net cover (12A). The container cover with foliage (10) further has a plurality foliage (16) is securely attached to the net cover (12).

3 Claims, 2 Drawing Sheets

COMPLETED "BUSHNET" COVER
(IN VARIOUS SIZES AND SHAPES)

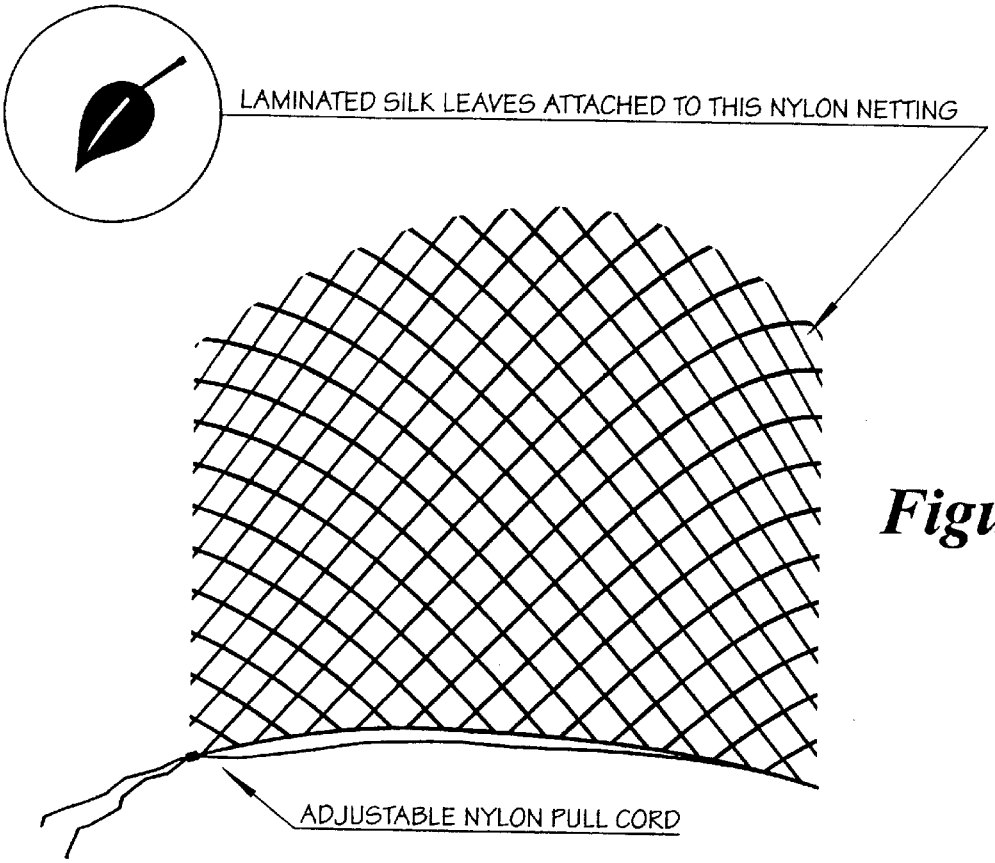
*Figure 3*
*Figure 2*
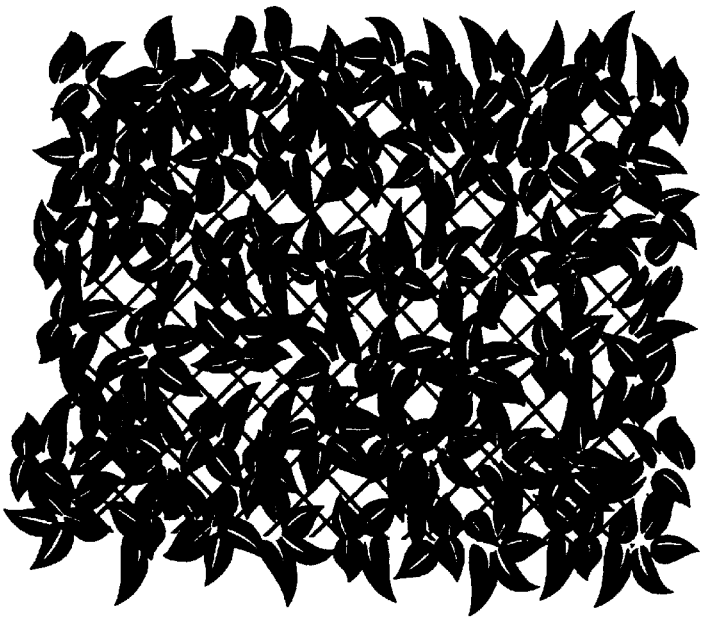
COMPLETED "BUSHNET" COVER
(IN VARIOUS SIZES AND SHAPES)

CONTAINER COVER WITH FOLIAGE

BACKGROUND OF THE INVENTION

1. Field of the Invention

The present invention relates to covers. More particularly, the present invention relates to container covers with foliage which function to give an aesthetic appearance to landscape having exposed containers.

2. Description of the Prior Art

Covers for a variety of products presently exist on the market. They range in configuration from boats to cars to motorcycle covers. To date, breathable aesthetic covers for exterior air conditioning units and other heat generating devices do not exist.

Numerous innovations for covers have been provided in the prior art that are described as follows. Even though these innovations may be suitable for the specific individual purposes to which they address, they differ from the present invention as hereinafter contrasted.

In U.S. Pat. No. 5,579,610, titled Leaf Retaining Net, invented by Robert L. Jackson, a net for covering raked leaves and similar plant debris is described. The net is bounded on two sides by two telescoping poles. A chain links the ends the ends of the two poles, and a second chain links the remaining ends of the two poles. The net is thus weighted to hug the ground and resist displacement by the wind. The net, being flexible, accommodates leaf piles of different volumes and dimensions. The telescoping poles and flexible chains both hold the net down by gravity, and also influence the overall configuration of the net. Opposing sides of the net attached to the poles remain straight, although of variable length due to telescoping. Opposing sides of the net attached to the chains are reconfigurable due to flexibility of the chains. The net is useful for immediately covering collected leaves, and preventing dispersion by the wind. Also, the net is suitable for longer term use in composting. Rings attached the poles enable stakes to secure the net in place for composting or other long term uses.

The patented invention differs from the present invention because the patented invention is net which is placed over items which can be scattered by the wind. Stakes hold the corners of the netting securely to the ground. The patented invention lacks simulated foliage and the capability to fit over an utility box. The present invention is a net bag device with an elastic closure device which is placed over an utility box. Simulated indigenous plant foliage attached to the outer surface of the net bag functions to camouflage the utility box.

In U.S. Pat. No. 5,510,167, titled Universal Cover for Armchairs, Sofas, and the like, invented by Francesco M. Candolfi, and Claudio DeFelice, a cover is disclosed which is formed from a non-elasticized cloth provided with stitches of elastic yarns stretched across the cloth back and attached thereto to form a quadrilateral mesh net.

The patented invention differs from the present invention because the patented invention is a cover for furniture comprised of a net backing which conforms to the shape of the item covered. The patented invention lacks a simulated foliage outer layer and an elastic closure device for the bottom. Further, the patented invention is more complex in that it is shaped to fit irregular shapes such as chairs and sofas. The patented invention lacks a weather resistance feature. Further, the patented invention is a protective device not a camouflage device. The present invention is a net bag which camouflages utility box.

In U.S. Pat. No. D349,565, titled Top Cover with Discharge Orifice for the Outdoor Unit of an Air Conditioning Split System, invented by Larry D. Burns and Frederick J. Keller, Jr., an ornamental design for a top cover with discharge orifice for the outdoor unit of an air conditioning split system, as shown and described.

The patented invention differs from the present invention because the patented invention is an ornamental design for a top cover. The patented invention lacks features similar to the present invention.

In U.S. Pat. No. 5,241,782, titled Wire-form Crop Cover Support, invented by E. Dennis McCarthy, Ronald W. Weekley, a support is described which is used for supporting a crop cover such as plastic sheet, cloth or netting that is often applied over crops in a field having a plurality of stakes which receive a plurality of the wire-form crop cover supports about their upper ends. The crop cover supports are either formed from a single typically galvanized wire or are formed from two or more galvanized wires welded together. The wire-form crop cover supports include a lower portion having a series of wire loops which are adapted to be disposed about the upper end of a stake, an intermediate wire portion including an upwardly extending flexible wire segment, and a top wire portion having a wire end, the top wire portion being shaped in such a manner that the wire end will not damage the crop cover. The wire-form crop cover support further includes a stop segment which may rest on the top end of the stake. When the wire-form crop cover supports of this invention are mounted upon the associated stakes they will support the crop cover in such a manner that a free floating "canopy" is provided well above the threatening stakes, which canopy may billow in the wind to break up frost stratifications.

The patented invention differs from the present invention because the patented invention is crop cover support system. The patented invention lacks features similar to the present invention.

In U.S. Pat. No. 5,171,390, titled Plant Base Cover, invented by Robert J. Travers, plant base cover and plant basket liner, each including a layer of an absorbent material adhesively bound to a netting that is preferably formed of a durable material such as nylon. The plant base cover includes a passage for admitting the base of a plant therethrough and a cut extending from an edge of the plant base cover to the edge of the passage to facilitate placement of the plant base cover around a plant. The plan basket liner is specifically sized and configured to be placed within conventionally-known plant baskets and is adapted to maintain a quantity of soil therein. The process of fabricating both the plant base cover and plant basket liner includes the steps of fabricating a layer of the insulating and absorbent material, securing a netting over the layer, and spraying the layer and the netting to adhesively bind them together.

The patented invention differs from the present invention because the patented invention is a plant base cover and plant basket liner. The patented invention lacks an outer simulated foliage layer. Further, the patented invention is described as a cover which has Spanish moss or sphagnum adhesively bonded to the outer layer insulating and absorbent for decorative purposes. The present invention is a netting which permits heat and air circulation. A simulated foliage is attached to the outer surface functioning to camouflage an utility box.

In U.S. Pat. No. 4,394,111, titled Top Cover, Motor, Fan and Fan Shroud Assembly for an Air Conditioning Unit, invented by John M. Wiese, Russell W. Hoeffken, a top cover, motor, fan and fan shroud for an air conditioning unit are assembled into an integrated structure with motor supporting legs which attach to the top cover and cause the shroud to be drawn against the cover. The legs connect with the shroud in a manner serving to preserve the concentricity of the shroud, and attach to the inside of a band which can be tightened to assure containment of the motor in a defined position under the shroud and vented portion of the cover.

The patented invention differs from the present invention because the patented invention is an assemble which improves the efficiency of assembling an air conditioner. The patented invention lacks features similar to the present invention.

In U.S. Pat. No. 4,263,246 Mercer Apr. 21, 1981 Net covering for articles Inventors: Mercer; Frank B., tubular net is described which has un-orientated annular zones, and orientated annular zones which contract transversely upon heat shrinking; the net can be used for packaging or sleeving, the un-orientated zones acting as end closures or neck holders and the ends of the orientated zones being heat shrunk to retain the other end of the article or articles being packaged or sleeved.

The patented invention differs from the present invention because the patented invention is net which functions to protect a bottle during shipment. The patented invention lacks features similar to the present invention.

In U.S. Pat. No. D244,293, titled Air Conditioner Condenser Cover, invented by Kenneth Carluccio, an ornamental design for an air conditioner condenser cover, substantially as shown.

The patented invention differs from the present invention because the patented invention is an ornamental design for an air conditioner condenser cover. The patented invention lacks features similar to the present invention.

Numerous innovations for covers have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a foliage pedestal cover that is primarily utilized to cover an utility pedestal. It has an elastic bottom to snugly fit around different size pedestals or to under a top lid. It will come in many different sizes, although many sizes will fit many shapes of the pedestal. The material utilized is light weight netting functioning to allow heat to escape. The netting is manufactured from a material which is mildew and rot proof The foliage is made of artificial indigenous plants to resemble the natural landscape. The entire cover is easily installed over a standard container. The cover is available in a variety of sizes. If a locking device is present on the container, it is easily poked through the mesh for access thereto.

The types of problems encountered in the prior art are exterior utility boxes are ugly and painting them does not significantly change their appearance.

In the prior art, unsucessful attempts to solve this problem were attempted namely: painting and solid or colored covers.

However, the problem was solved by the present invention because it contains foliage which resembles the natural landscape surrounding the container.

Innovations within the prior art are rapidly being exploited in the field of covers.

The present invention went contrary to the teaching of the art which teaches solid covers or painted covers which are non-breathable to allow heat to escape.

The present invention solved a long felt need for a breathable cover which is aesthetically pleasing.

The present invention produced unexpected results namely: the foliage prevented some rain and moisture from hitting the container which lasted longer and rusted less.

A synergistic effect was produced utilizing the present invention due to the following facts and results from experimentation: that the container lasted longer without maintenance due to the foliage.

Accordingly, it is an object of the present invention to provide a container cover with foliage having a net cover with an elastic cord and a plurality of indigenous artificial foliage attached thereto. The net cover comprises a bottom net cover, a left net cover, a right net cover, a front net cover, a back net cover, and a net cover top.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—container cover with foliage (10)
12—net cover (12)
12A—bottom net cover (12A)
12L—left net cover (12L)
12R—right net cover (12R)
12F—front net cover (12F)
12B—back net cover (12B)
14—elastic cord (14)
16—foliage (16)
18—container (18)

BRIEF DESCRIPTION OF THE DRAWINGS

FIG. 2 is a right side view of a container cover with foliage being placed over a container.

FIG. 3 is a top view of a container cover with foliage mounted over a container.

DESCRIPTION OF THE PREFERRED EMBODIMENT

Figure 1:
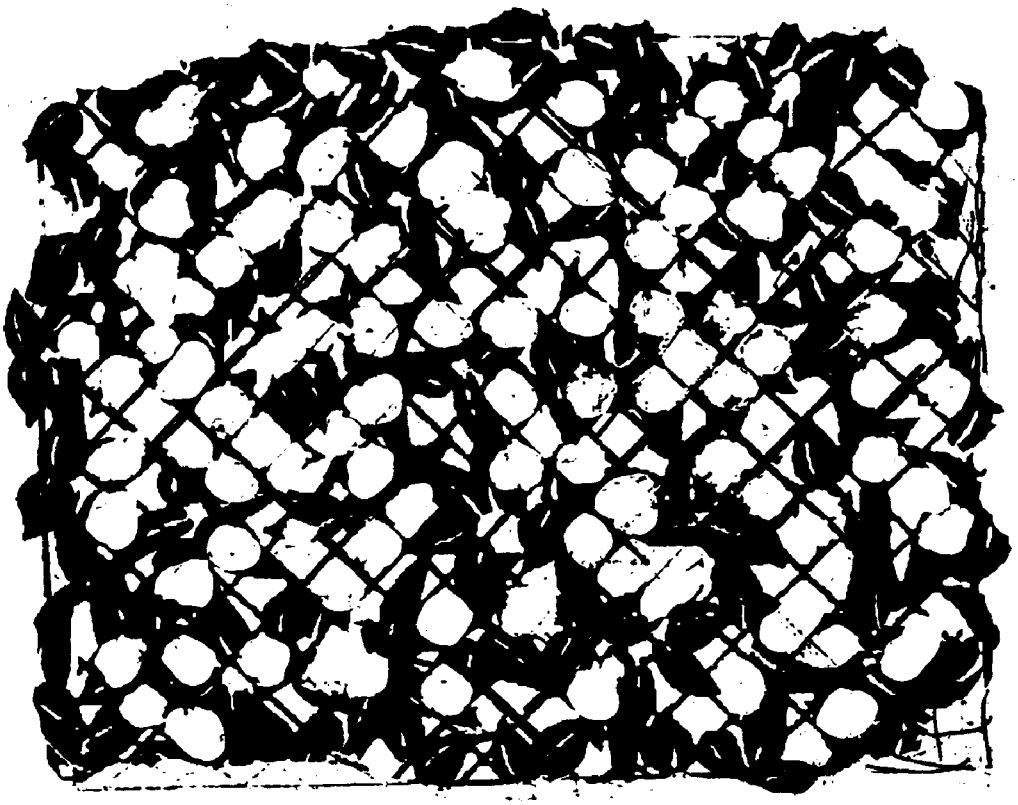
FIG. 1 is a right side view of a container cover with foliage mounted over a container.

Referring to FIG. 1 which is a right side view of a container cover with foliage (10) mounted over a container (18) and FIG. 3 which is a top view of a container cover with foliage (10) mounted over a container (18). The container cover with foliage (10) functions to aesthetically cover a container (18). The container cover with foliage (10) comprises a net cover (12) which comprises a left net cover (12L) attached along a front distal edge to a left distal edge of a front net cover (12F) which is attached along a right distal edge to a front distal edge of a right net cover (12R) which is attached along a rear distal edge to a right distal edge of a back net cover (12B) which is attached along a left distal edge to a rear distal edge of the left net cover (12L). A net cover top (12T) is attached along a left edge and a right edge and a front edge and a back edge to a top edge of the left net cover (12L) and the right net cover (12R) and the front net cover (12F) and the back net cover (12B), respectively. A bottom net cover (12A) is located circumferentially along a bottom edge of the net cover (12). The net cover (12) is manufactured from a material selected from a group consisting of plastic, plastic composite, rubber, rubber composite and natural fibers.

The container cover with foliage (10) further comprises a plurality foliage (16) is securely attached to the net cover (12). The foliage (16) is preferably attached utilizing wire or plastic clips but can optionally be attached by weaving line or wire. The foliage (16) is preferably artificial which requires little or no maintenance. The foliage (16) selected from a group consisting of leaves, flowers, branches, stalks, and shrubs. The foliage (16) is selected to conform to the natural surroundings of the container (18) to give a natural aesthetic appearance.

Now referring to FIG. 2 is a right side view of a container cover with foliage (10) being placed over a container (18). The container cover with foliage (10) further comprises an elastic cord (14) positioned within a closed flap formed in the bottom net cover (12A). The elastic cord (14) functions to securely hold a bottom of the container cover with foliage (10) around the container (18).

It will be understood that each of the elements described above, or two or more together, may also find an useful application in other types of constructions differing from the type described above.

While the invention has been illustrated and described as embodied in a cover, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A container cover with foliage (10) functioning to aesthetically cover a container (18), the container cover with foliage (10) comprising:

A) a net cover (12) which comprises a left net cover (12L) attached along a front distal edge to a left distal edge of a front net cover (12F) which is attached along a right distal edge to a front distal edge of a right net cover (12R) which is attached along a rear distal edge to a right distal edge of a back net cover (12B) which is attached along a left distal edge to a rear distal edge of the left net cover (12L), a net cover top (12T) is attached along a left edge and a right edge and a front edge and a back edge to a top edge of the left net cover (12L) and the right net cover (12R) and the front net cover (12F) and the back net cover (12B), respectively, a bottom net cover (12A) is located circumferentially along a bottom edge of the net cover (12);

B) an elastic cord (14) is positioned within a closed flap formed in the bottom net cover (12A); and C) a plurality of artificial foliage (16) is securely attached to the net cover (12).

2. The container cover with foliage (10) as described in claim 1, wherein the net cover (12) is manufactured from a material selected from a group consisting of plastic, plastic composite, rubber, rubber composite and natural fibers.

3. The container cover with foliage (10) as described in claim 1, wherein the foliage (16) selected from a group consisting of leaves, flowers, branches, stalks, and shrubs.

* * * * *